US005987857A

United States Patent [19]

Haddow et al.

[11] Patent Number: 5,987,857

[45] Date of Patent: Nov. 23, 1999

[54] PACKAGING APPARATUS

[75] Inventors: Philip Gordon Haddow; Graham Leonard Shirley, both of Coventry, United Kingdom

[73] Assignee: Lipton, Division of Conopco, Inc., Englewood Cliffs, N.J.

[21] Appl. No.: 08/923,594

[22] Filed: Sep. 4, 1997

[30] Foreign Application Priority Data

Sep. 9, 1996 [EP] European Pat. Off. ..... 96306533

[51] Int. Cl.[6] ..... B65B 63/02

[52] U.S. Cl. ..... 53/527; 53/529; 53/248

[58] Field of Search ..... 53/527, 529, 530, 53/248, 250, 260

[56] References Cited

U.S. PATENT DOCUMENTS

| | | | |
|---|---|---|---|
| 3,086,564 | 4/1963 | Staff | 141/81 |
| 3,088,499 | 5/1963 | Rieger | 141/81 |
| 3,325,977 | 6/1967 | Kirsten | 53/250 |
| 3,501,890 | 3/1970 | Hunt | 53/124 |
| 3,509,681 | 5/1970 | Sass | 53/35 |
| 3,968,619 | 7/1976 | Fishburne | 53/24 |
| 4,085,563 | 4/1978 | Egee et al. | 53/250 X |
| 4,718,540 | 1/1988 | Greenwell | 198/627 |
| 4,874,067 | 10/1989 | Greenwell | 192/4 R |
| 5,038,919 | 8/1991 | Harston | 198/626.1 |
| 5,145,053 | 9/1992 | Krieger | 198/626.5 |
| 5,224,911 | 7/1993 | Wong | 53/426 |
| 5,401,156 | 3/1995 | Anderson | 425/147 |

FOREIGN PATENT DOCUMENTS

| | | |
|---|---|---|
| 1 090 626 | 10/1954 | France . |
| 3335754 | 4/1985 | Germany . |
| 96/07592 | 3/1996 | WIPO . |

*Primary Examiner*—Linda Johnson
*Attorney, Agent, or Firm*—James J. Farrell

[57] ABSTRACT

Packing apparatus on a conveyor line for use in filling cartons with compressible articles comprises first and second tamping pistons (4,6) operating in sequence in a chamber (2) to successively compress the articles and drive them through a chute (2*a*) into a carton (C). A planar shutter (32) is provided at the bottom of the chute (2*a*) to close it between carton-filling operations. The chute and carton are separated by only the shutter so as to minimize the gap between them and also to facilitate the extension of the driving piston (6) into the container to pack the articles more firmly therein. The shutter rotates on a vertical axis offset from the chute with its lower face contacting the cartons and moves generally in the direction of advance of the carton along the conveyor line.

12 Claims, 3 Drawing Sheets

PACKAGING APPARATUS

Figure 1:
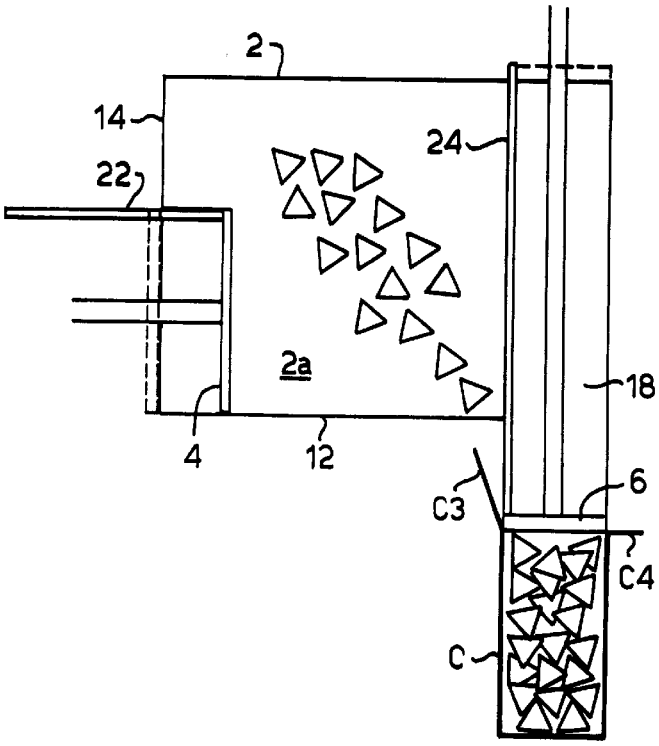

This invention relates to packaging apparatus for dispensing quantities of articles to containers.

It is particularly concerned with the packaging of compressible articles into containers when, if the articles initially contain a substantial amount of air, they will occupy a relatively large space but will subsequently settle to leave considerable free space within the container. This is not only wasteful in terms of the size of container that must be provided, but it can also cause deterioration or damage of the articles as they move about with less restraint during handling of the filled containers.

To reduce the space occupied by articles being packed, it is known to apply compression during packing using a two-stage tamping process in which articles gathered in a main receiving space are confined to a smaller space to one side of that space by a first tamping device before they are discharged to the container by a second tamping device moving through the smaller receiving space. In this process, it is known to form that smaller receiving space with a chute fitting within a bag which forms the final container, for example as in the bag-filling apparatus shown in U.S. Pat. No. 3,086,564 where a pivoted valve plate forming a side wall of the chute within the bag ensures that the articles are held until the second tamping device drives them through the chute and into the bag.

That known apparatus requires the bag to be slid over the chute before filling, and the second tamping device, in filling the bag, also ejects it from the chute. The sliding of the bags onto the chute and the removal of the filled bags after ejection requires the continuous attendance of an operator, who would also have to close the filled bags. If the described sequence were to be operated without human intervention a relatively complex handling system would be required, and an added complication would be the need to perform the necessary motions while maintaining any closure elements of the bag correctly positioned.

In another known apparatus described in DE 3335754, the second tamping device drives the articles into a former tube of a form fill apparatus, the top of which is normally closed by a reciprocating slide valve which moves away when the tamping device descends through the smaller receiving space, but the articles can only be pressed into the packaging tube before the final container or package is formed. The top closure of the package, in which a transverse seal is made across the packaging tube, must make allowance for the articles expanding again. It must leave free space above the articles if it is to be made securely.

Other known arrangements shown in U.S. Pat. Nos. 3,088,449 and 4,108,063 operate to pack the goods horizontally into their containers. As in the first described example above, the container to be filled must be fitted over a discharge passage into which the articles are driven, with the same complications of handling and control of the containers, both before and after filling, which make mechanical handling difficult and in particular militate against any high-speed processing system.

It would be desirable to have a form of packaging apparatus for compressible articles that can be readily employed to fill containers under the control of conveyor means in a mechanical handling packing line, as described for example in WO96/07592. In that instance, compressible articles in the form of tea bags which can contain a substantial amount of air as they are formed, are packed into flapped cartons, through the open top of the carton, the flaps of which are folded over to close the carton further along the packing line. It is therefore necessary to ensure that the flaps are held clear when the articles are being inserted, and to ensure that they are protected against damage as they pass through the filling station.

In one of its aspects, the present invention provides a packaging apparatus for dispensing a quantity of articles to an open-topped container having flaps for closure of the container after filling, comprising conveyor means for progressing the container along a travel path past a filling chute, said conveyor means being arranged to bring the container into register with said chute, a tamping device for dispensing a quantity of the articles through the chute into the container, and a shutter for closing the chute, said shutter being rotatable in a plane between the bottom of the chute and the top of the container about an axis offset from the container path, the direction of rotation of the shutter being arranged to displace it across the bottom of the chute generally in the direction of travel of the container along said path.

The use of such a shutter makes it possible to control the collection and discharge of articles into a series of spaced containers from a continuously arriving stream of articles.

The shutter can also assist in the guidance of the containers through the filling station. By arranging that the shutter moves in the direction of flow of the containers along a conveyor line, there is less risk of the movement of the containers resulting in damage to any flaps or like closure elements on the open containers if the containers are brought immediately adjacent to the tamping chute in order to ensure that the articles are packed into them closely.

According to another aspect of the invention, there is provided apparatus for dispensing a quantity of articles to a container, comprising a receiver for the articles and a tamping device for transferring articles from the receiver to the container, the space swept by the final said tamping device extending into an exit chute and means for locating the container in register with the chute, said device forming a sliding seal with the exit chute when located therein, the chute having an open outlet end and a closure shutter being displaceable across said outlet end between the chute and the container to retain the articles therein during at least a part of the period during which said final device is not sealing the exit chute.

It is possible, by using apparatus of the form described, to arrange that the tamping device follows the articles being discharged to extend from the chute into each container so as to compress the articles that have entered the container. In this way it can be ensured that any elastic recovery following compression of the article does not result in their overflowing the container.

Conveniently, a static guide is disposed upstream of said shutter for holding open at least one top flap of each container at a level substantially coincident with the shutter. The shutter may then be put in a position in which its rear edge is close to said fixed guide when a container is progressed forwards from said guide.

Preferably, a rotational movement of the shutter to close the chute outlet is arranged to take place during the displacement of each container away from said chute, and the shutter is held clear of the container during said movement by virtue of having a radially recessed region nearest the container during said movement.

Figure 2:
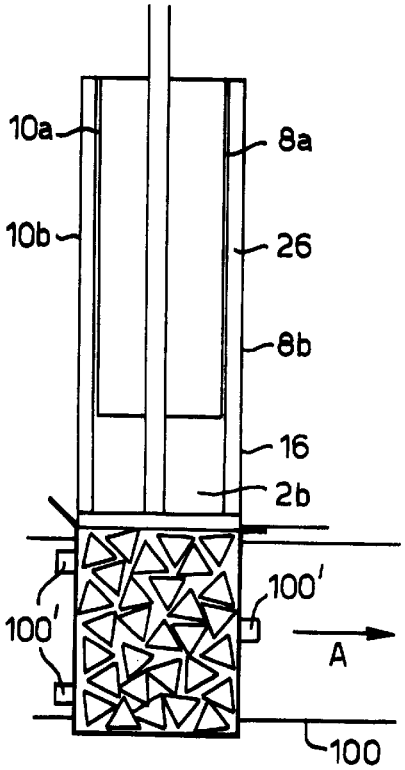
Figure 3:
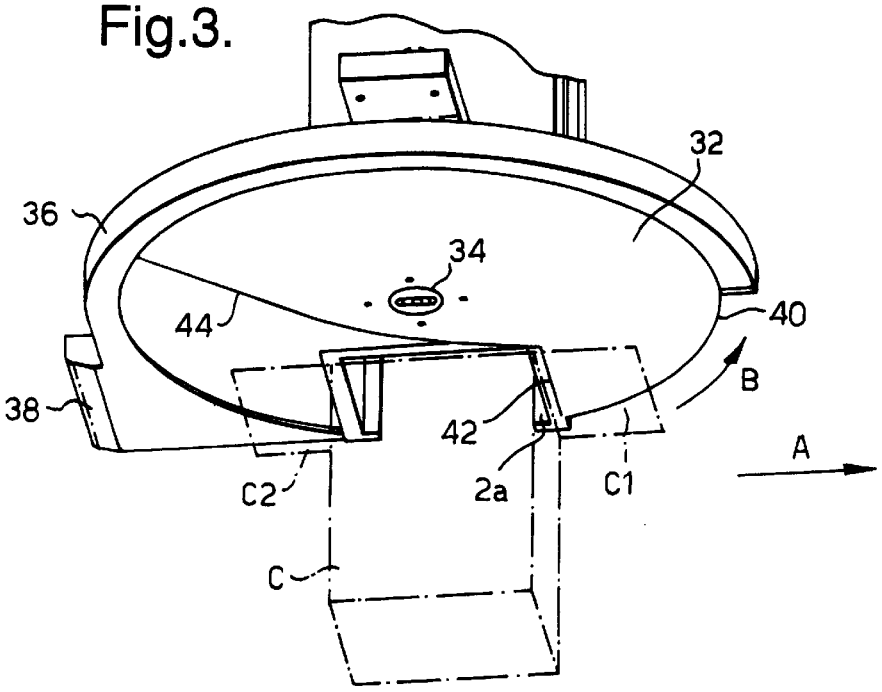

By way of example, an embodiment of the invention will be described by reference to the accompanying diagrammatic drawings, in which:

FIGS. 1 and 2 illustrate apparatus according to the invention in side and front views, FIG. 3 is an oblique view from below illustrating the shutter of the apparatus and its shroud, FIGS. 4–9 are views similar to FIG. 1 illustrating a series of stages in the filling of a container by the apparatus, and FIGS. 10–17 illustrate the shutter and a carton in plan view at different stages during the rotation of the shutter.

Figure 4:
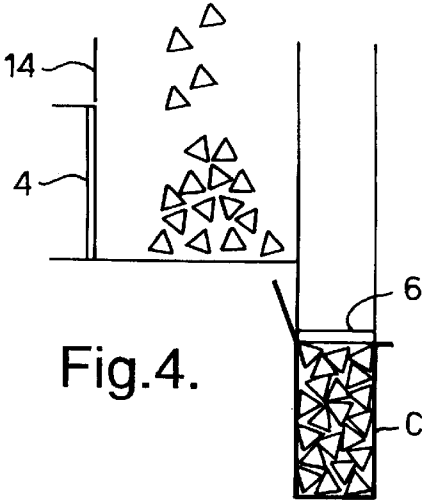
Figure 7:
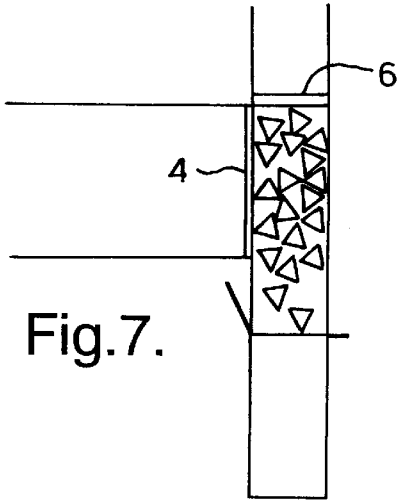

FIGS. 1 and 2 show the apparatus at a filling station in a container handling system such as that shown in WO96/07592, the contents of which are incorporated herein by reference. FIG. 2 illustrates fragmentarily the conveyor 100 of the system which moves in the direction A (FIGS. 2 and 3). The packaging apparatus comprises a collection chamber 2 in which first and second tamping pistons 4,6 are operable. The tamping piston 4 sweeps the lower region of a first space 2*a* of the chamber which opens into a second, smaller space 2*b* in which the tamping piston 6 operates. The width of the first space 2*a* in the direction of conveyor movement is less than that of the second space 2*b*, as indicated in FIG. 2 by the spacing of the walls 8*a*,10*a* of the first space and of the walls 8*b*,10*b* of the second space. Both pistons fit slidably between the walls 8*a*,10*a* and 8*b*,10*b* of their respective spaces. The first piston 4, which also slides over the bottom wall 12, is displaceable horizontally between end wall 14 (as shown in FIG. 4) and the path of the second piston 6 (as shown in FIG. 7). The second piston 6 is displaceable vertically from a position above the first piston 4, as shown in FIG. 7, to sweep the second space 2*b* of the chamber, which extends into a chute 16 depending below the first space 2*a*.

The walls of the chamber extend above the piston 4 and its swept space 2*a* to provide an entry region for articles falling into the chamber from delivery means which are not shown. As the piston 4 moves to the right from a fully retracted position in line with the end wall 14, a top cover 22 integral with the piston forms a platform preventing articles from falling behind the piston head.

The piston 6 has an integral side cover 24 which, when the piston descends into the chute 16, as shown in FIG. 1, closes off the second space 2*b* from the first space 2*a*. In the margins of the second space 2*b* beyond the width of the first space, guide tracks 26 are provided for rollers (not shown) mounted on the side cover 24 to support the piston 6. The rollers are spring loaded to prevent rubbing contact of the sliding faces of the piston with the chamber and chute in order to reduce wear and to allow rapid movements of the piston without the need for lubrication of the sliding faces. Similar roller guides are provided for the piston 4 although these are not illustrated. The small clearances that are left between the sliding pistons 4,6 and the walls of the chamber 2 may be arranged to widen progressively in the direction of advance of the pistons if there is any risk from the form of the articles that they can become trapped between the pistons and the chamber walls.

The bottom of the chute defines an exit opening which can be closed by a rotary shutter 32. The shutter 32 is in the form of a thin plate mounted on a vertical rotary shaft 34, the drive means for which are not shown but which are synchronised with the movement of the conveyor 100. The profile of the shutter, described in detail below, allows it to be positioned clear of the chute exit at the stage of operations shown in FIGS. 1–3, so that it does not obstruct passage between the chute and a container held registered with the chute exit to be filled by articles collected in the chamber 2. The shutter is located in a fixed shroud 36 with its rotary axis offset from the chamber 2, the chute 16 projecting to the lower face of the shroud. The separation between the chute and the carton is thus kept to a minimum, being no more than that required by the planar shutter for a running clearance.

As can be seen in WO96/07592, the conveyor 100 moves open cartons C, in particular cartons having outwardly turned top closure flaps, along a horizontal path, past the filling station where the required quantity of articles is packed into each carton and through further stations where the flaps are closed and the filled cartons sealed. During these operations each carton is held continuously by gripping elements, shown at 100' in FIG. 2. Also associated with the conveyor are means for delivering the articles to the filling station, which can be done in a generally continuous manner, although it will normally be required to ensure that a pre-set number of articles is placed in each carton.

The present drawings show the cartons with top closure flaps C1–C4 of which the front and rear flaps C1,C2 appear in most figures but FIG. 1 showing opposite side flaps C3,C4. In the approach to the carton filling structure, the flaps C1,C2 are held horizontally outwards, one extending forwards in the direction of travel A and the other rearwards, by means of fixed rails (not shown) that meet an entry chamfer 38 on the shroud, and then by the shutter 32. The side flaps C3,C4 are held in the positions shown in FIG. 1 by conventional means, eg. by fixed rails, as they do not pass across the chute exit opening.

The shutter 32 has a profile comprising an outer arcuate edge 40 concentric to its rotary axis, a straight edge 42 directed inwards from one end of the arcuate edge, and a convex inner curved edge 44 between the inner end of the straight edge 42 and the outer arcuate edge 40. In the carton-filling position, the straight edge 42 of the shutter is aligned with the front edge of the collection chamber chute 16 so leaving the bottom exit from the chute clear. The shutter 32 rotates clockwise as seen from above, as indicated by arrow B in FIG. 3, and when a filled carton moves away from the chute 16 the shutter turns to a position blocking the chute exit. The outer arcuate edge 40 then lies close to the entry chamfer 38 of the shroud so that a substantially continuous bearing surface is provided to hold the top flaps of an arriving carton, and in particular the leading top flap, horizontal, and to guide that leading top flap past the chute 16.

As the arriving carton is moved forwards into place under the chute, the shutter 32 rotates to move with it but is displaced at a faster rate across the chute opening in order to clear the opening when the carton is registered with it. The two movements take place in generally the same forward direction, however, so that the risk of scuffing the carton or otherwise damaging the flaps is minimised. Because the shutter is displaced in rotation, it will be noted that it continues to move in the same direction as a filled carton moves on and an empty carton arrives. If the spacing between the cartons must be kept small the shutter can cooperate with both cartons at the same time during the changeover.

In more detail, a cycle of operations includes the following steps, beginning at the point at which a carton has been filled and is about to be carried away from the filling station by the conveyor system.

Figure 10:
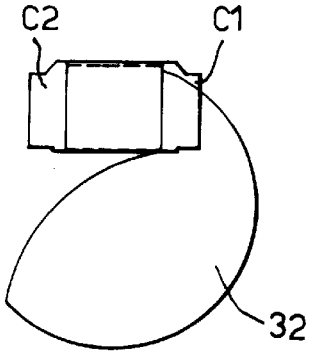

This is the position shown in FIG. 2, and also in FIGS. 4 and 10. The first piston 4 is in a fully withdrawn position at this stage, allowing further articles to accumulate in the chamber while the second piston 6 is extended to the bottom of the chute closing off the second region 18 of the chamber. Because of the piston side cover 24, the entering articles cannot be trapped behind the piston 6 and are held in the first space 2*a*.

Figure 11:
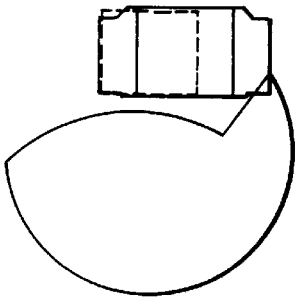
Figure 12:
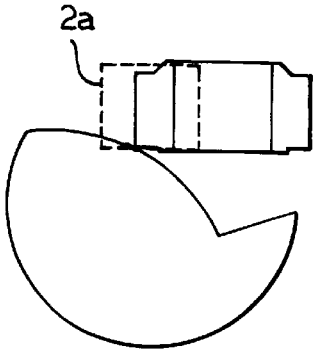
Figure 13:
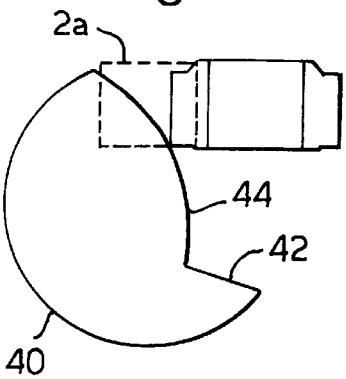
Figure 14:
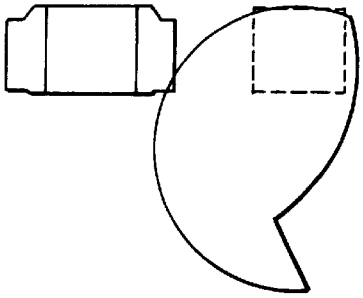

As the filled carton moves away (FIGS. 11–13), the shutter 32 begins to rotate, but because the inner curved edge 44 then moves closest to the carton path, it remains out of contact with the rear flap C2 of the carton to avoid any risk of damage. In fact, the inner curved edge is so formed that this portion of the shutter does not initially protrude over the path of the carton (FIGS. 11 and 12). The vertical piston 6 begins to rise but still separates the two spaces 2*a*,2*b* of the chamber 2 so further articles cannot enter the chute.

Figure 6:
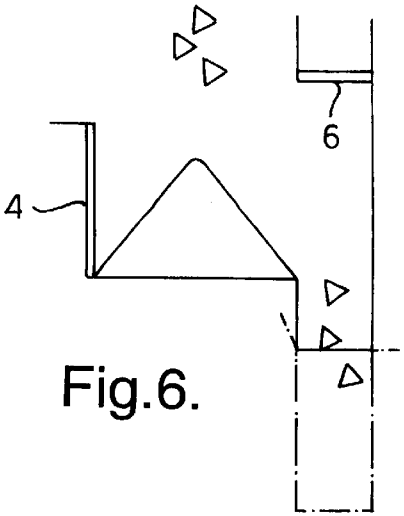

Immediately after the filled carton has cleared the chute 16 the exit opening is closed off to the passage of articles by the shutter 32. The vertical piston 6 can now immediately be drawn above the bottom wall 12 of the first space 2*a*, as shown in FIG. 6, allowing articles already collecting in the chamber to fall into the chute where they will be trapped by the shutter. The vertical piston continues to rise until it is above the horizontal piston 4 and a further carton arrives under the shroud 36. The shutter, which by this stage has turned about half a revolution from the position shown in FIG. 10, is still rotating, keeping the chute exit closed and also providing a bearing face for the leading top flap of the carton being indexed (FIG. 14), as mentioned above. By this stage, the required number of articles has been collected in the chamber 2 and the first piston 4 moves forwards to press them into the second space 2*b* (FIG. 7). As this takes place, the entering carton is registered with the chute.

Figure 15:
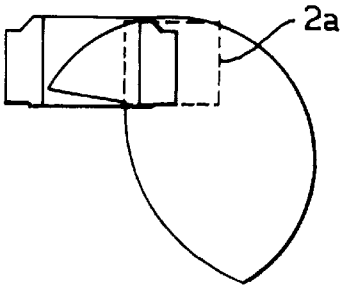
Figure 16:
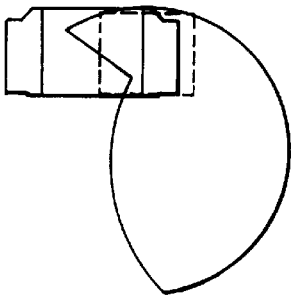
Figure 17:
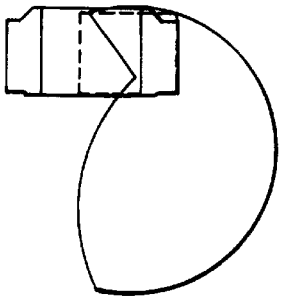

The shutter 32 begins to open the chute exit while the carton is still moving into position, but the initial portion of the exit uncovered opens directly into the mouth of the carton, as can be seen in FIGS. 15–17. Articles already falling into the second space 2*b* can therefore escape freely through the chute into the carton. The second piston 6 remains in its upper position, however, until the carton has come to rest in register with the chute exit. The shutter rotation stops at the same time, with the straight edge 42 aligned with the front edge of the chute, as shown in FIGS. 3 and 10.

Figure 9:
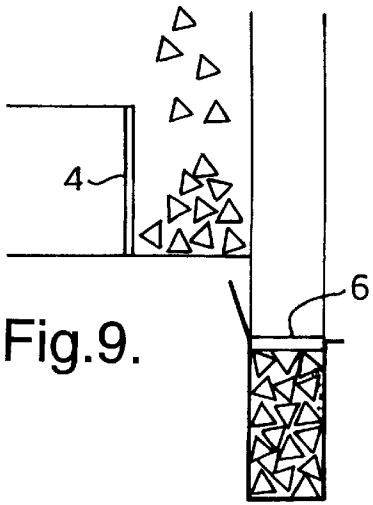
Figure 5:
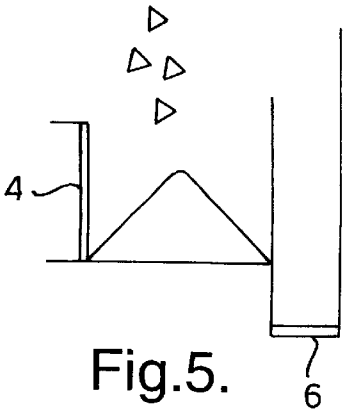
Figure 8:
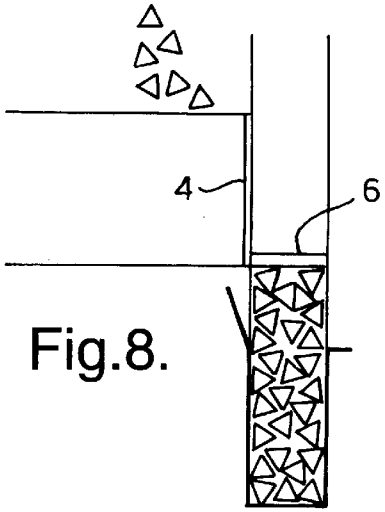

The second piston 6 now descends while the first piston 4 remains extended, and it moves past the bottom of the chute, a small distance into the carton, as shown in FIG. 9, in order to compress the articles sufficiently to ensure they will not spring back above the top of the carton when the tamping pressure is removed. The first piston 4 can be retracted as soon as the second piston has moved past the bottom wall 2 to close off the second space 2*b* of the chamber (FIG. 8). Any articles that have arrived in the chamber while the first piston was extended are swept off the top cover 22 into the first space 2*a*.

With the lifting of the second piston 6 sufficiently to clear the carton and shutter, the system completes the cycle. The conveyor 100 begins to move again to carry the filled carton away and bring a further carton in its place, and the rotation of the shutter also begins again.

It will be noted that the closure of the chute exit to the passage of articles is a combined function of the second tamping piston 6, its side cover 24 and the shutter 32. By coordination of the operation of these components it is possible to operate high filling rates while ensuring that compressible articles are reduced in volume and are packed down into their containers. The coordination of the movements of the apparatus through computer controlled servo actuators in a manner known per se, can be arranged to optimise the running speed, and can also be arranged to adapt the apparatus rapidly to changes of container size or quantities of articles to be packed.

We claim:

1. Packaging apparatus for dispensing a quantity of articles to an open-topped container having a main body and flaps for closure of the container open top after filling said main body, comprising:

conveyor means for progressing the container along a travel path;

a container filling means above said travel path;

the filling means having a receiver for the articles, an exit opening from the receiver and at least one tamping device displaceable in the receiver for directing articles in the receiver through said opening;

said exit opening facing said travel path for the registration of the container open top with the exit opening to transfer the articles from said receiver into the container;

the filling means further including a shutter for closing said exit opening and disposed in a plane between the exit opening and the top of the container;

a rotary mounting for displacement of the shutter in said plane across the opening to open and close the opening, said mounting being laterally offset from the travel path of the articles;

the shutter having a direction of rotation that displaces the shutter across said opening generally in the direction of travel of the container along said path.

2. Apparatus according to claim 1 wherein a static guide is disposed at a location along said travel path upstream of said shutter for holding open at least one top flap of the container at a level substantially coincident with the shutter.

3. Apparatus according to claim 1 wherein said tamping device blocks the passage of further articles through said filling means opening while a filled container moves away from under the opening.

4. Apparatus according to claim 1 wherein the tamping device is displaceable to extend through said filling means exit opening into the container to compress the articles therein.

5. Apparatus according to claim 1 wherein the filling means comprises a receiver in which a plurality of tamping devices are successively displaceable in sequence for transferring articles from a first region swept by the or each preceding device of said plurality of devices to a region swept by the succeeding to said preceding device.

6. Apparatus according to claim 5 wherein the region swept by the final tamping device of said plurality of devices continues to an exit chute, said final device forming a sliding seal with said chute while being located therein.

7. Apparatus according to claim 2 wherein the shutter comprises a portion that extends close to said fixed guide prior to the registration of the container with said opening, for forming a substantially continuous bearing surface with the fixed guide for said top flap.

8. Apparatus according to claim 1 wherein the shutter comprises a portion which is located in a position immediately adjacent the filling means exit opening and forwards of the container body in the direction of container travel when the container body is registered with said exit opening, whereby to provide a location for an open front flap of the container.

9. Apparatus according to claim 1 wherein the shutter has a radially recessed region, said rotation of the shutter displacing said recessed region past said filling means opening during the movement of the container away from said filling means, whereby the shutter is clear of the opening until the container body is moved out of coincidence with the opening.

10. Apparatus for dispensing a quantity of articles to a container, comprising:

a receiver for the articles;

an outlet chute extending from said receiver;

at least two tamping devices for sweeping respective regions of said receiver;

the tamping devices being successively displaceable in the receiver in sequence for transferring articles from the region swept by the or each preceding device of said at least two devices to the region swept by the succeeding device to said preceding device;

the region swept by a final tamping device of said at least two devices continuing into the outlet chute;

said final tamping device forming a sliding seal with said chute when sweeping the continuation of said region in the chute;

the chute having an exit end remote from the receiver;

a planar closure shutter mounted adjacent said exit end;

the closure shutter being displaceable in its own plane across said exit end to close said chute during at least a part of the period during which said final tamping device is retracted clear of the chute.

11. Apparatus for dispensing quantities of articles to containers comprising;

a receiver for the articles;

an outlet in the receiver at a lower region thereof;

means for progressing a succession of the containers below the outlet transversely across the opening and locating individual containers of said succession in turn beneath the outlet;

a tamping device displaceable in the receiver and through said outlet for transferring the articles from the receiver to each individual container located beneath the opening;

a closure shutter being displaceable across the outlet between the outlet and the container at intervals between the locating of successive said containers below said opening;

said tamping device being displaceable through said outlet into each individual container located beneath the opening to compress the articles therein.

12. Packaging apparatus for dispensing a quantity of articles to an open-topped container having flaps for closure of the container after filling, comprising:

a container filling means comprising a receiver for the articles, an outlet chute leading from and extending downwardly below the receiver, and an exit opening at a lower end of the chute remote from the receiver;

conveyor means for progressing the container along a horizontal travel path extending directly below said exit opening, said conveyor means being arranged to bring the container into register with said opening;

the receiver having mutually adjacent first and second regions, the second region being disposed directly above the outlet chute;

a first tamping device horizontally displaceable in the first region of the receiver for transferring articles from the first region to the second region;

a second tamping device downwardly displaceable in the second region of the receiver and into the outlet chute for dispensing articles from the second region through the chute exit opening;

a side cover on the second tamping device and displaceable therewith for providing a partition between the first and second regions of the receiver when said second device has been displaced into the chute;

a shutter below said exit opening for closing said exit opening when the second tamping device is withdrawn from the chute, said shutter being displaceable across the exit opening substantially in the direction of container movement along said travel path past said exit opening.

* * * * *